US009033171B2

(12) United States Patent
Bobritski

(10) Patent No.: US 9,033,171 B2
(45) Date of Patent: May 19, 2015

(54) FOLDABLE CRATE AND LOCKING MECHANISMS THEREFOR

(71) Applicant: Jakov Bobritski, Kibuts Cabri (IL)

(72) Inventor: Jakov Bobritski, Kibuts Cabri (IL)

( * ) Notice: Subject to any disclaimer, the term of this patent is extended or adjusted under 35 U.S.C. 154(b) by 0 days.

(21) Appl. No.: 14/321,783

(22) Filed: Jul. 1, 2014

(65) Prior Publication Data

US 2014/0312034 A1 Oct. 23, 2014

Related U.S. Application Data

(62) Division of application No. 13/685,727, filed on Nov. 27, 2012, now Pat. No. 8,807,367.

(51) Int. Cl.

| | |
|---|---|
| ***B65D 88/52*** | (2006.01) |
| ***B65D 25/28*** | (2006.01) |
| ***B65D 6/16*** | (2006.01) |
| ***B65D 25/30*** | (2006.01) |
| *B65D 6/18* | (2006.01) |
| *B65D 6/26* | (2006.01) |

(52) U.S. Cl.

CPC ..... *B65D 88/528* (2013.01); *B65D 25/2885* (2013.01); *B65D 7/26* (2013.01); *B65D 7/30* (2013.01); *B65D 11/18* (2013.01); *B65D 11/1833* (2013.01); *B65D 25/30* (2013.01); *B65D 2255/20* (2013.01)

(58) Field of Classification Search

CPC ..... B65D 11/1833; B65D 11/18; B65D 7/30; B65D 7/26; B65D 7/24; B65D 1/42; B65D 88/528; B65D 88/526; B65D 88/52; B65D 9/22; B65D 9/18; B65D 9/14; B65D 9/12

USPC ..... 220/7, 6, 4.33, 4.28; 217/45, 43 R, 36, 217/13, 12 R; 206/600, 386

See application file for complete search history.

(56) References Cited

U.S. PATENT DOCUMENTS

| | | | |
|---|---|---|---|
| 6,290,081 | B1 | 9/2001 | Merey |
| 7,861,878 | B2 | 1/2011 | Escarpa Gil |
| 2010/0230406 | A1 | 9/2010 | Yamauchi |
| 2010/0320202 | A1 | 12/2010 | Yamauchi |
| 2012/0091133 | A1 | 4/2012 | Escarpa Gil |

FOREIGN PATENT DOCUMENTS

| | | |
|---|---|---|
| EP | 1655232 | 5/2006 |
| EP | 2431283 | 3/2012 |
| WO | 2009100799 | 8/2009 |
| WO | 2010146190 | 12/2010 |

*Primary Examiner* — Robert J Hicks

(74) *Attorney, Agent, or Firm* — Mark David Torche; Patwrite LLC

(57) ABSTRACT

A foldable crate includes a base platform, a pair of longitudinal sidewalls forming a hinged connection with the base platform and a pair of flanking sidewalls forming a hinged connection with the base platform. The flanking sidewalls accommodate a locking mechanism, which includes an actuator, a transmission mechanism and a pair of locking elements, threaded into channels at the top portion of the flanking sidewalls.

7 Claims, 10 Drawing Sheets

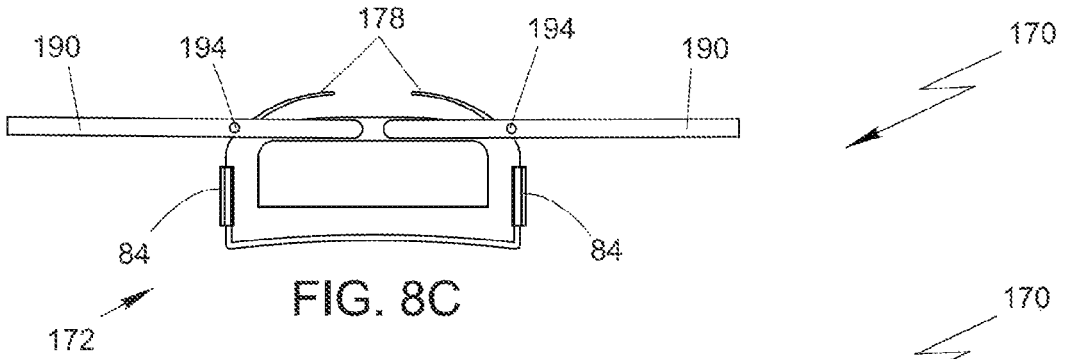
FIG. 8C
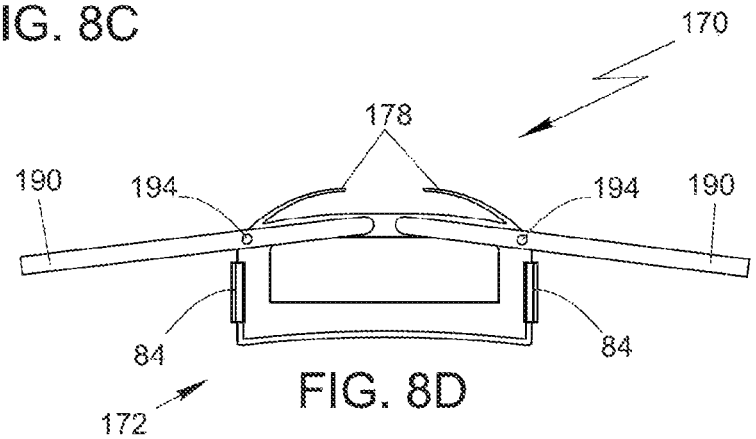
FIG. 8D
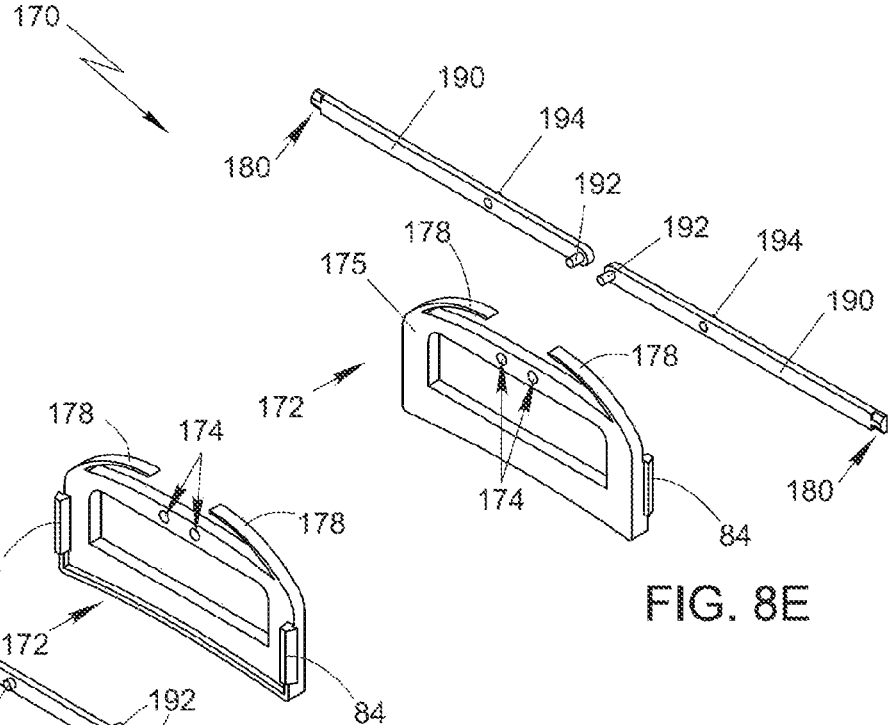
FIG. 8E
FIG. 8F

FOLDABLE CRATE AND LOCKING MECHANISMS THEREFOR

CROSS REFERENCE TO RELATED APPLICATIONS

The present application is a divisional of Ser. No. 13/685,727 that is currently allowed. The present application claims the benefit of domestic priority from Ser. No. 13/685,727. The content of Ser. No. 13/685,727 is incorporated herein by reference.

TECHNICAL FIELD

The present invention pertains to containers, in particular foldable crates and locking mechanism therefor. In particular, the invention relates to advances in and elaborations of locking mechanisms for foldable crates, with a novel safety feature, characterized by enhanced reliability and durability as well as by the ease of manufacture methods and reduced costs of production.

BACKGROUND OF THE INVENTION

Foldable crates are widely used these days. There are numerous solutions known in the art for locking mechanisms for foldable crates. The general concept of such locking mechanisms is that a foldable crate can be secured in open conformation, by a locking mechanism, which is releasable by an actuator, typically a tab surrounding the handle of the crate. It is believed that the pertinent state-of-the-art is represented by: U.S. Pat. Nos. 7,861,878, 6,290,081, US20100230406, US20120091133 and US20100320202; EP2431283 and EP1655232; as well as by WO2010146190 and WO2009100799.

US20120091133 discloses a collapsible box including a plastic structure with a rectangular base, two ends, and two sides which are pivotably coupled to the base. The ends include centered parts combined with latches, which in one position anchor the sides and ends, while in another position the connection between the ends and the sides is released in order to collapse the elements. The collapsible box of US20120091133 is characterized in that the box includes an anchor device consisting of a series of rotary bodies that connect the latches to the centered part via two pairs of resilient parts and which, in the inoperative position thereof, hold the latches outwards, attaching the ends and the sides. When the central part is moved upward, the latches thus release the ends and the sides.

U.S. Pat. No. 7,861,878 discloses a fastening device for folding boxes. The folding boxes include a bottom and four lateral walls coupled in jointed fashion to the edges of that bottom, two opposite walls each having a fastening device for ensuring the unfolding of the box. The fastening devices of U.S. Pat. No. 7,861,878 include a vertically displaceable central piece and lateral bolts with horizontal displacement for fastening the lateral walls via their adjacent edges. The fastening device of U.S. Pat. No. 7,861,878 includes elastic spring elements that link the central control piece with pairs of the lateral bolts. The spring elements, in the rest position, maintain the bolts in an engagement and fastening position. The release position of the bolts in U.S. Pat. No. 7,861,878 results when the spring elements pull the bolts against the resistance of the elastic elements.

In light of numerous solutions of state-of-the-art locking mechanisms for foldable crates, advances in and elaborations of such locking mechanisms for foldable crates, which will provide for a novel safety feature, enhanced reliability and durability as well as the ease of manufacture and reduced costs of production, possesses a clear utilitarian and economic benefit.

SUMMARY OF THE INVENTION

The invention relates to advances in and elaborations of locking mechanisms for foldable crates, with a safety feature, providing enhanced reliability and durability as well as ease of manufacture and reduced production costs.

There is provided in accordance with embodiments of the present invention a foldable crate including a base platform, a pair of longitudinal sidewalls forming a hinged connection with the base platform and a pair of flanking sidewalls forming a hinged connection with the base platform. The flanking sidewalls accommodate a locking mechanism, which includes an actuator, a transmission means and a pair of locking elements, threaded into channels at the top portion of the flanking sidewalls.

In accordance with some embodiments of the present invention, the transmission mechanism includes a rotor.

In accordance with some embodiments of the present invention, the transmission means includes a pair of sinusoidally shaped driving extensions having a shape of an essentially complete sinusoidal cycle and positioned horizontally, in the direction of translation of the locking elements.

It should be understood, however, that the summary above is not intended to limit the invention to the particular forms and examples, rather on the contrary, is to cover all modifications, equivalents, and alternatives falling within the scope of the invention.

BRIEF DESCRIPTION OF THE DRAWINGS

The present invention will be understood and appreciated more comprehensively from the following detailed description taken in conjunction with the appended drawings in which:

FIG. 8C is a front view of the locking mechanism of the flanking sidewall, shown in FIG. 7A, in closed conformation;

FIG. 8D is a front view of the locking mechanism of the flanking sidewall, shown in FIG. 7A, in open conformation;

FIG. 8E is an exploded frontal isometric view of the locking mechanism of the flanking sidewall, shown in FIG. 7A;

FIG. 8F is an exploded posterior isometric view of the locking mechanism of the flanking sidewall, shown in FIG. 7A;

Figure 1A:
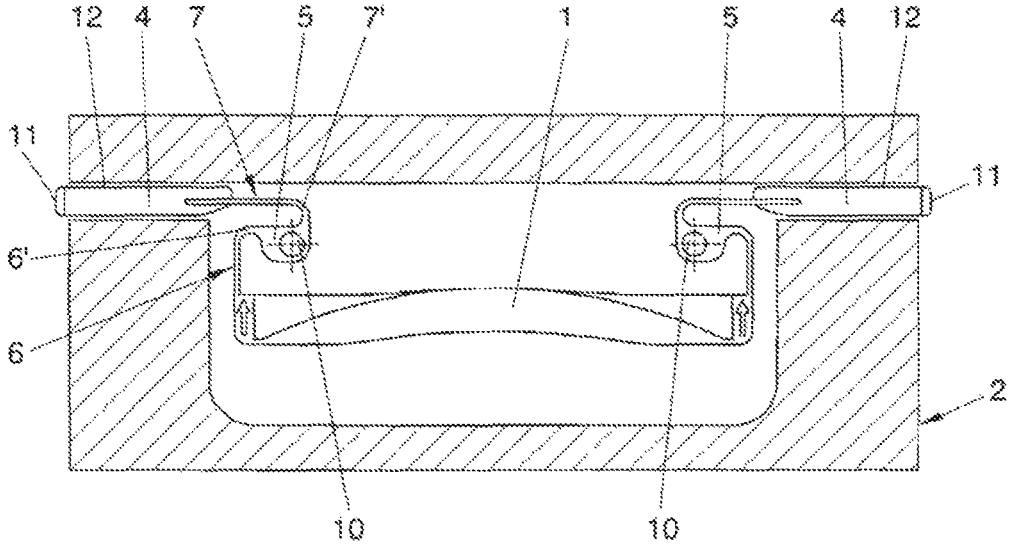
FIG 1A PRIOR ART
FIGS. 1A and 1B are FIGS. 3 and 4 from publication US2012091133, showing features of prior art locking mechanisms for foldable crates.

While the invention is susceptible to various modifications and alternative forms, specific embodiments thereof have been shown merely by way of example in the drawings. The drawings are not necessarily complete and components are not essentially to scale; emphasis instead being placed upon clearly illustrating the principles underlying the present invention.

DETAILED DESCRIPTION OF THE INVENTION

Illustrative embodiments of the invention are described below. In the interest of clarity, not all features of actual implementation are described in this specification. It will of course be appreciated that in the development of any such actual embodiment, numerous implementation-specific decisions must be made to achieve the developers' specific goals, such as compliance with technology- or business-related constraints, which may vary from one implementation to another. Moreover, it will be appreciated that the effort of such a development might be complex and time-consuming, but would nevertheless be a routine undertaking for those of ordinary skill in the art having the benefit of this disclosure.

Figure 1B:
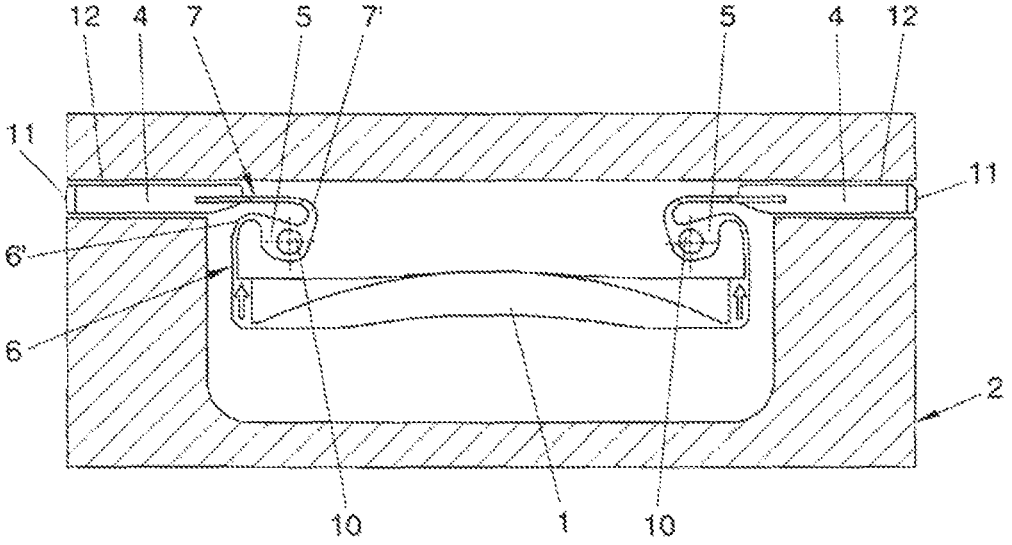
FIG 1B PRIOR ART

In order to explain the locking mechanisms for foldable crates, of the instant invention, reference is now made to paragraphs 0035 to 0044 of US20120091133. In accordance with prior art locking mechanisms for foldable crates, reference is now made also to FIGS. 1A and 1B, which are FIGS. 3 and 4 from US20120091133. The collapsible box disclosed in US20120091133 includes two anchoring devices, each of which is determined from a central control piece 1 arranged in correspondence with each of the front ends 2 of a plastic box. The control piece 1 is connected to a pair of side bolts 4 through rotary bodies 5. One pair of thin elastic portions 6 connect the front ends of the central piece 1 to the rotary bodies 5 while the other pair of elastic portions 7 associates the rotary bodies 5 with the side bolts 4. These are disposed in complementary slots 12. The box of US20120091133 comprises a base or bottom, on the edges of which being hingely coupled two major side walls or flanks and two minor side walls or front ends 2, so that to achieve the folded position, the front ends 2 are first folded down until being placed on a plane superimposed on the base, to then folding down the flanks until being placed on another plane superimposed on the front ends 2 already folded.

Rotary bodies 5 in US20120091133 are hingely coupled to shafts 10, integral with the front ends 2. Side bolts 5 include front end latches 11, which protrude from the side edges of the front ends 2 in a resting position and through which the front ends 2 are anchored in the flanks during the assembly of the box. Elastic portions 6 and 7 comprise straight sections with extremely short curved elbows 6' and 7', through which they are attached to the rotary bodies 5 while the straight sections of the elastic pieces 7 are attached to the bolts 4 in the same direction. The straight sections of the other elastic paired pieces 6 are attached perpendicularly to front ends of central control piece 1. With the arrangement described in US20120091133, when two central pieces 1 against the resistance of the elastic portions 6 and 7 are simultaneously moved upward, while the assembled box being in the unfolded position, the bolts 4 are horizontally moved toward the center of the front ends 2 hiding the latches 11, thereby releasing the front ends 2 by folding down until being placed on a plane superimposed on the base, then folding down the flanks until being stable and supported on the front ends 2.

Figure 2A:
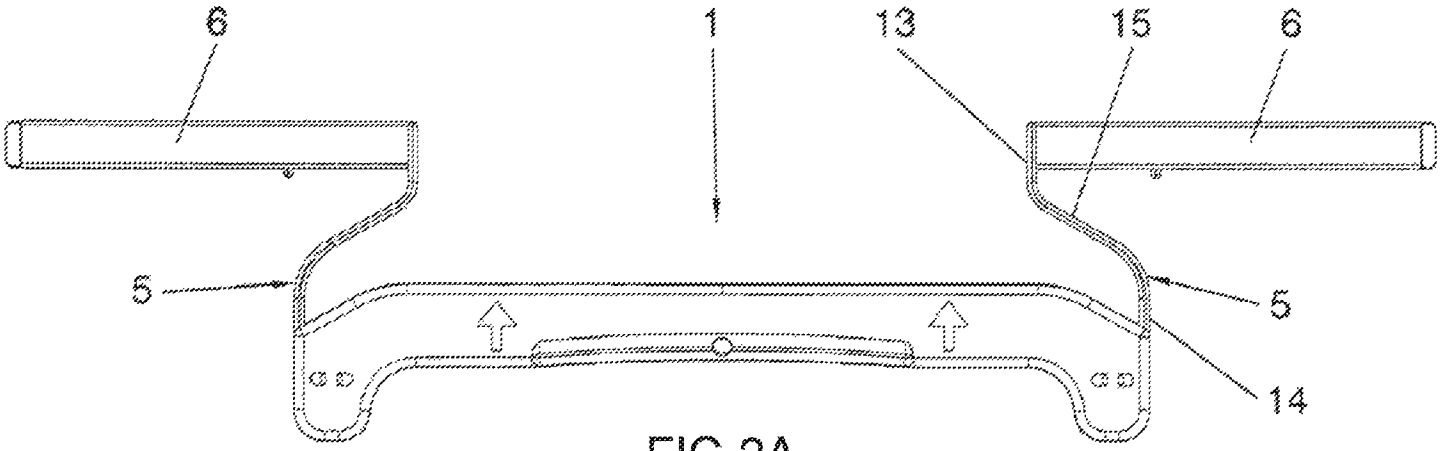
FIG 2A PRIOR ART
FIGS. 2A and 2B are FIGS. 3 and 4 from publication U.S. Pat. No. 7,861,878, showing features of prior art locking mechanisms for foldable crates.
Figure 2B:
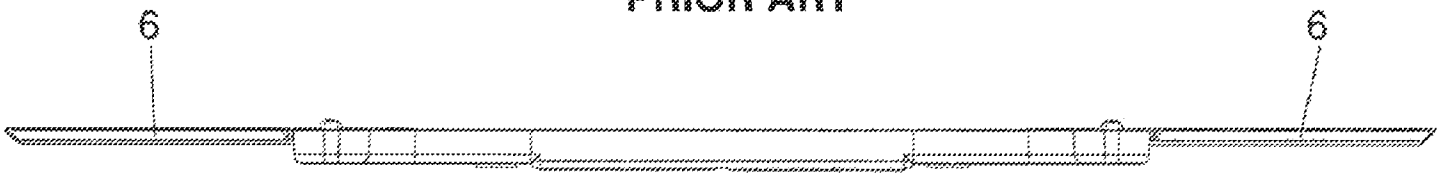
FIG 2B PRIOR ART

Reference is now made to columns 3 and 4 of U.S. Pat. No. 7,861,878 and FIGS. 2A and 2B, which are FIGS. 3 and 4 from U.S. Pat. No. 7,861,878, showing a fastening device for folding boxes. Folding boxes in U.S. Pat. No. 7,861,878 are defined by the basis of a central control piece 1 coupled in each of the end walls of the box, at the same time as it is guided between two vertical ribs integral with end walls, so that central piece 1 can thus slide in the vertical direction. Extending upward from the ends of central control piece 1 are two elastic spring elements 5 which are in turn joined to pairs of bolts 6 aligned in the same horizontal direction and guided in other pairs of ribs, in such a way that the end sections of bolts 6 fit into some cavities of the ends of the side walls of the box in the unfolded or assembled position. Central control piece 1 possesses short frontal extensions with thicker portions at their ends, which fit into complementary grooves of the end walls in order to secure the linkage of central pieces 1 of other elements joined to them to the respective end wall. Central control piece 1, pairs of elastic springs 5, pairs of bolts 6, extensions and thick end portions of the frontal extensions are all elements of a single integral body. Each elastic spring element 5 comprises an end portion 13 and an end portion 14 joined to the respective bolt 6 and central control piece 1, and an inclined central section 15 which forms an obtuse angle with respect to the end portions 13 and 14. When control piece 1 is displaced upwards, the spring elements 5 deform and accumulate elastic energy, and they pull the bolts towards the center of the end wall, thereby releasing the linkage with the lateral wall of the box, so that those walls can then be collapsed in order to fold the box. Afterwards, when central control pieces 1 are no longer acted on, both central control pieces 1 and springs 5 and bolts 6 return their initial position due to the elastic energy of the springs 5.

FIG. 3A to 4C show components of an embedment of foldable crate 30 as well as locking mechanism 80 thereof. Foldable crate 30 comprises base platform 32. Base platform 32 has a plurality of structural recesses 34, disposed about longitudinal portion 36 of base platform 32; and structural recesses 38 disposed about flanking portion 40 thereof. Longitudinal recesses 34 and flanking recesses 38 accommodate longitudinal pivots 42 and flanking 44 pivots, respectively, adapted to form a hinged connection with longitudinal sidewalls 50 and flanking sidewalls 60 of foldable crate 30. Optionally, at least one of pivots 42 or 44 is a single extended rod, typically metallic, threaded throughout the entire length of longitudinal portion 36 or flanking portion 40 of base platform 32. The superior face of longitudinal portions 36 of base platform 32 are positioned somewhat higher than the superior face of flanking portion 40; whereas longitudinal pivots 42 are positioned somewhat higher than flanking pivots 44.

Foldable crate 30 further comprises a pair of longitudinal sidewalls 50 and a pair of flanking sidewalls 60, of which just a single sidewall from each pair is shown. Longitudinal sidewalls 50 include a plurality of structural elements 52, disposed about bottom portion 54 thereof. Structural elements 52 disposed about bottom portion 54 of longitudinal sidewalls 50 are adapted to be inserted into structural recesses 34, disposed about longitudinal portion 36 of base platform 32. Structural elements 52 disposed about bottom portion 54 include an aperture (not shown) adapted to receive longitudinal pivot 42, thereby forming a hinged connection between longitudinal sidewalls 50 and longitudinal portion 36 of base platform 32.

Longitudinal sidewalls 50 include tab 56, adapted to serve as a gripping handle. Longitudinal sidewalls 50 include flanking extensions 58 extending essentially perpendicularly and inwardly along a substantial length of the vertical edges of longitudinal sidewalls 50. It is further noted that flanking extensions 58 of longitudinal sidewalls 50 preferably terminate spaced apart from the bottom longitudinal sidewalls 50, forming rectangular recesses 59 towards the bottom of flanking extensions 58.

Flanking sidewalls 60 include a plurality of structural elements 62, disposed about bottom portion 64 thereof. Structural elements 62 disposed about bottom portion 64 of flanking sidewalls 60 are adapted to be inserted into structural recesses 38, disposed about flanking portion 40 of base platform 32. Structural elements 62 disposed about bottom portion 64 include an aperture (not shown) adapted to receive flanking pivot 44; thereby forming a hinged connection between flanking sidewalls 60 and flanking portion 40 of base platform 32.

Flanking sidewalls 60 include tab 66, adapted to serve as a gripping handle. It is noted that flanking sidewalls 60 include side recesses 68, extending essentially inwardly, along a substantial length of the vertical edges of flanking sidewalls 60. It is further noted that side recesses 68, of flanking sidewalls 60, preferably terminate at some distance from the bottom longitudinal sidewalls 60; hence forming rectangular protrusions 69 towards the bottom of flanking recesses 68.

Flanking sidewalls 60 comprise structured centric recess 70, essentially surrounding tab 66. Structured centric recess 70, of flanking sidewall 60, is adapted to accommodate locking mechanism 80. Locking mechanism 80 further comprises locking elements 96, threaded into channels 65 at the top portion of flanking sidewalls 60. Structured centric recess 70 in flanking sidewalls 60 comprises deepened bottom portion 72 and top face 74. Structured centric recess 70 includes a couple of grooves 76 along a portion of the sides thereof and protrusion 78, essentially surrounding the top portion of tab 66. Structured centric recess 70 further embodies circular indentation and/or aperture 79, positioned preferably symmetrically about the vertical centerline of structured centric recess 70, adapted to accommodate rotor 90 of locking mechanism 80 and sustain the rotation thereof.

Figure 3A:
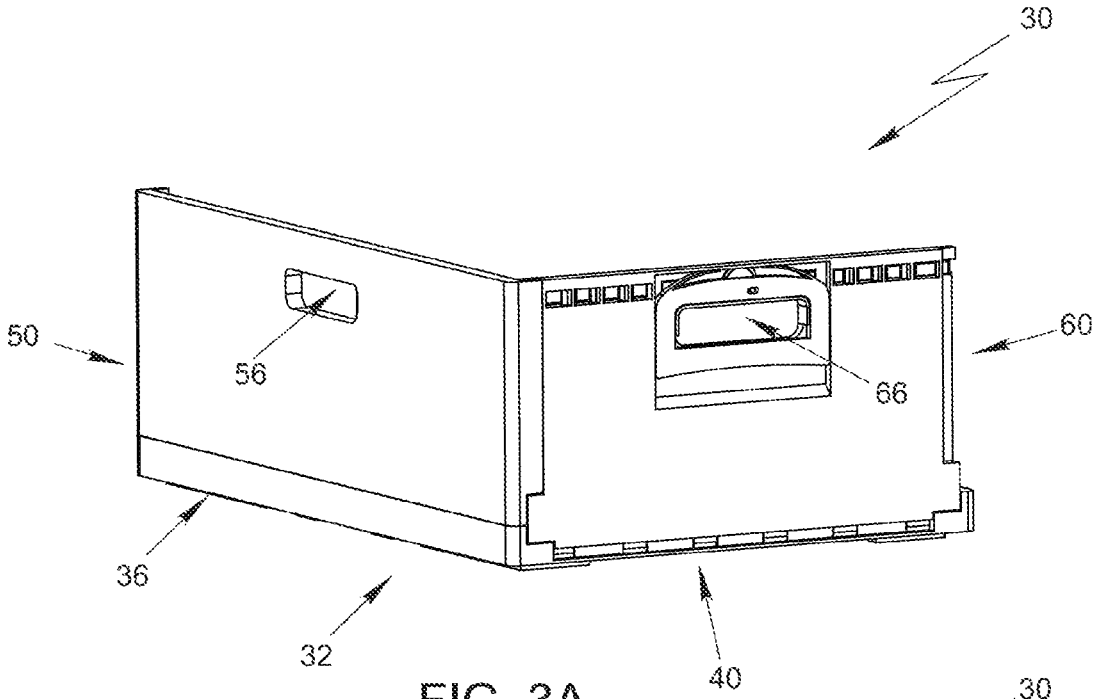
FIG. 3A is an isometric view of a partially assembled foldable crate and locking mechanism therefor, in accordance with an embodiment of the instant invention.
Figure 3B:
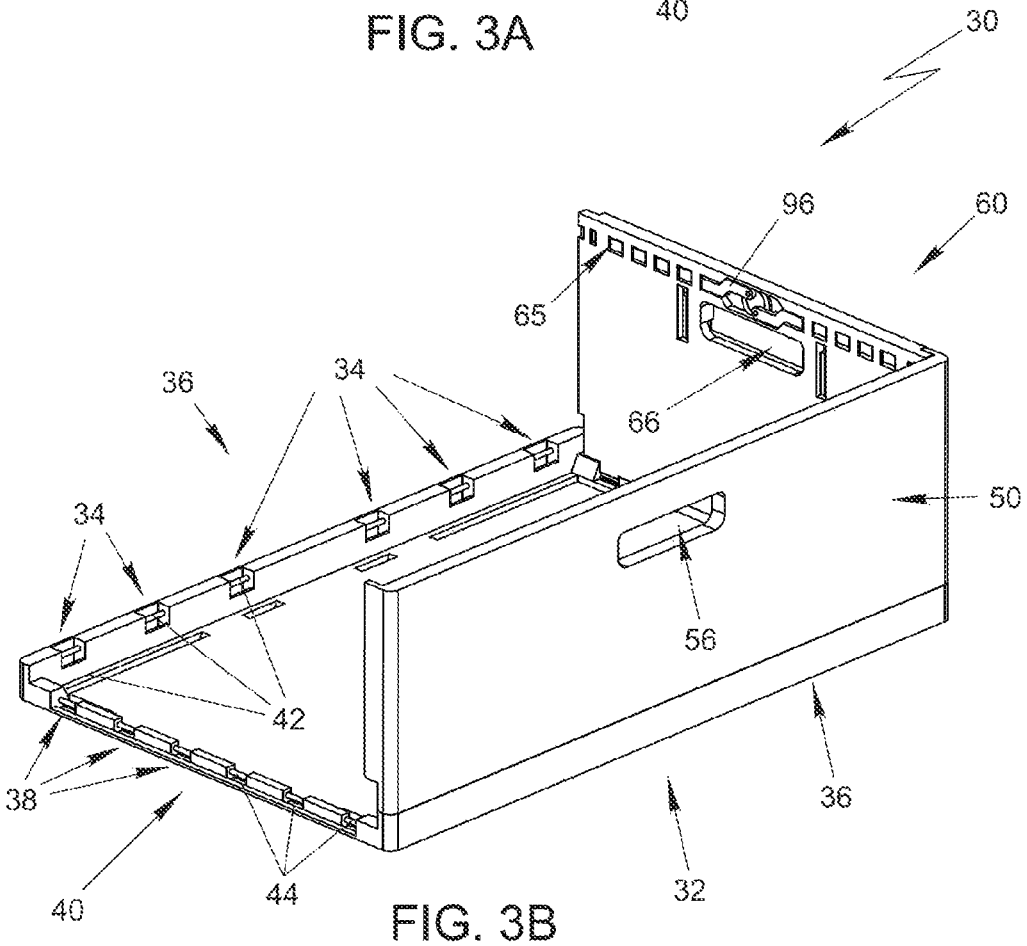
FIG. 3B is a posterior perspective view of the partially assembled foldable crate, shown in FIG. 3A.
Figure 3C:
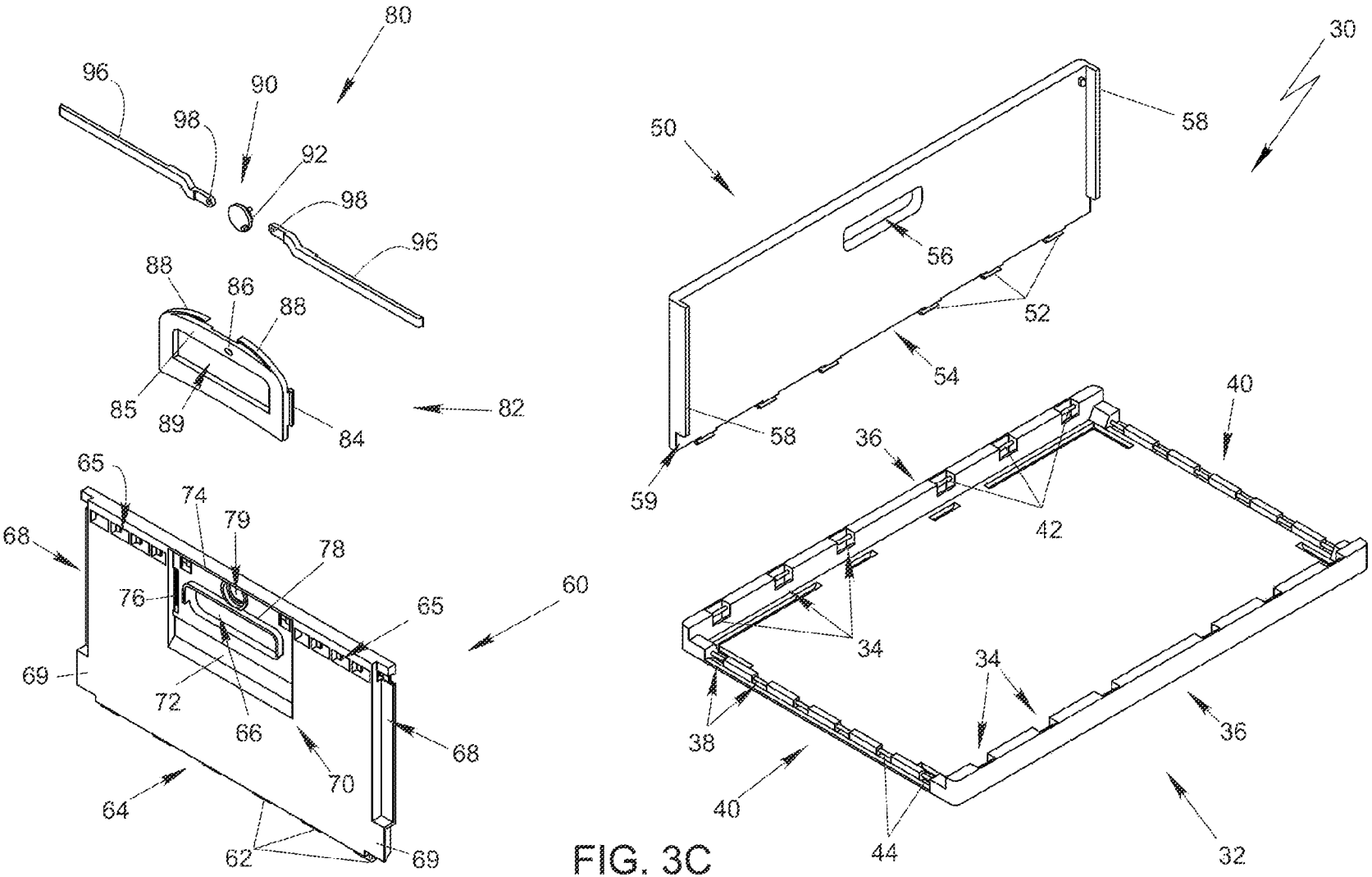
FIG. 3C is an exploded isometric view of the foldable crate as well as locking mechanism thereof, shown in FIG. 3A and FIG. 3B.

It is noted that in the assembled state of crate 30, shown in FIGS. 3A and 3B, flanking extensions 58 of longitudinal sidewalls 50 overlap side recesses 68 of flanking sidewalls 60, thereby interlocking flanking sidewalls 60, in an upward position, adjacent to longitudinal sidewalls 50. Moreover in the assembled state of crate 30, shown in FIGS. 3A and 3B, rectangular protrusions 69 towards the bottom of flanking recesses 68 of flanking sidewalls 60 interlock into rectangular recesses 59 towards the bottom of flanking extensions 58 of longitudinal sidewalls 50.

Figure 4A:
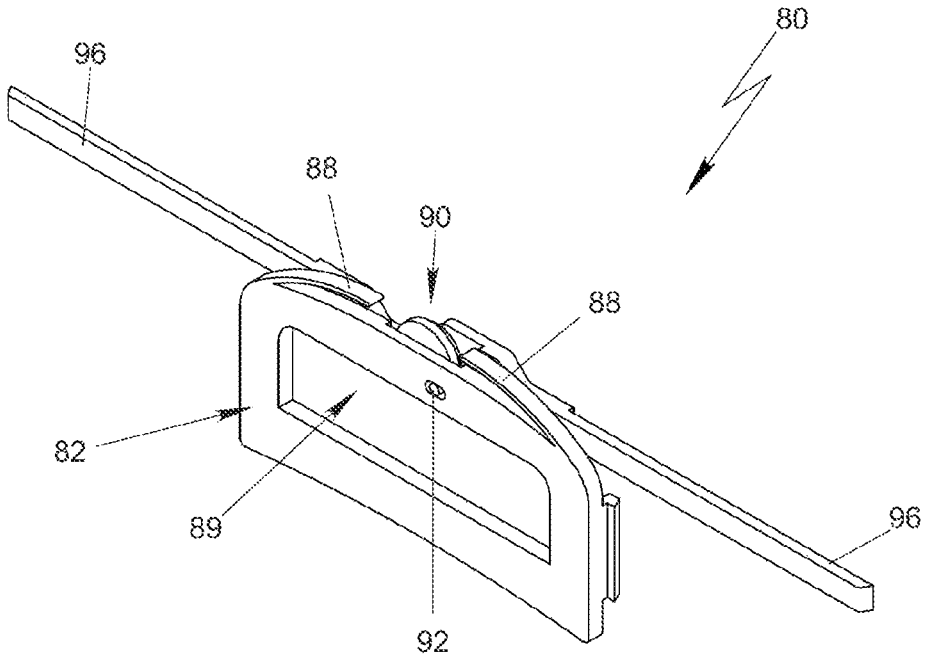
FIG. 4A is a frontal isometric view of the locking mechanism of the foldable crate, shown in FIG. 3A.
Figure 4B:
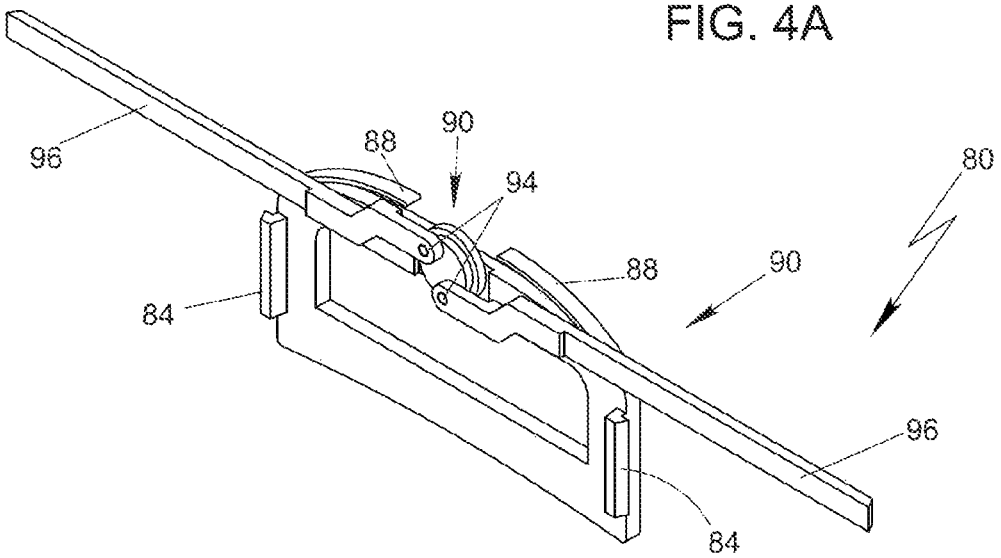
FIG. 4B is a posterior isometric view of the locking mechanism of the foldable crate, shown in FIG. 3A.
Figure 4C:
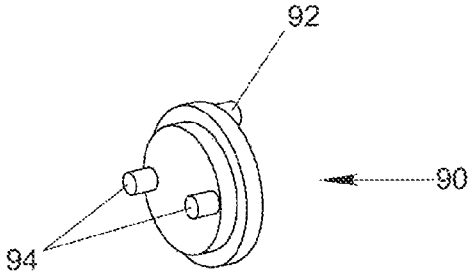
FIG. 4C is an isometric view of the rotor of the locking mechanism for the foldable crate, shown in FIG. 4A and FIG. 4B.
Figure 5A:
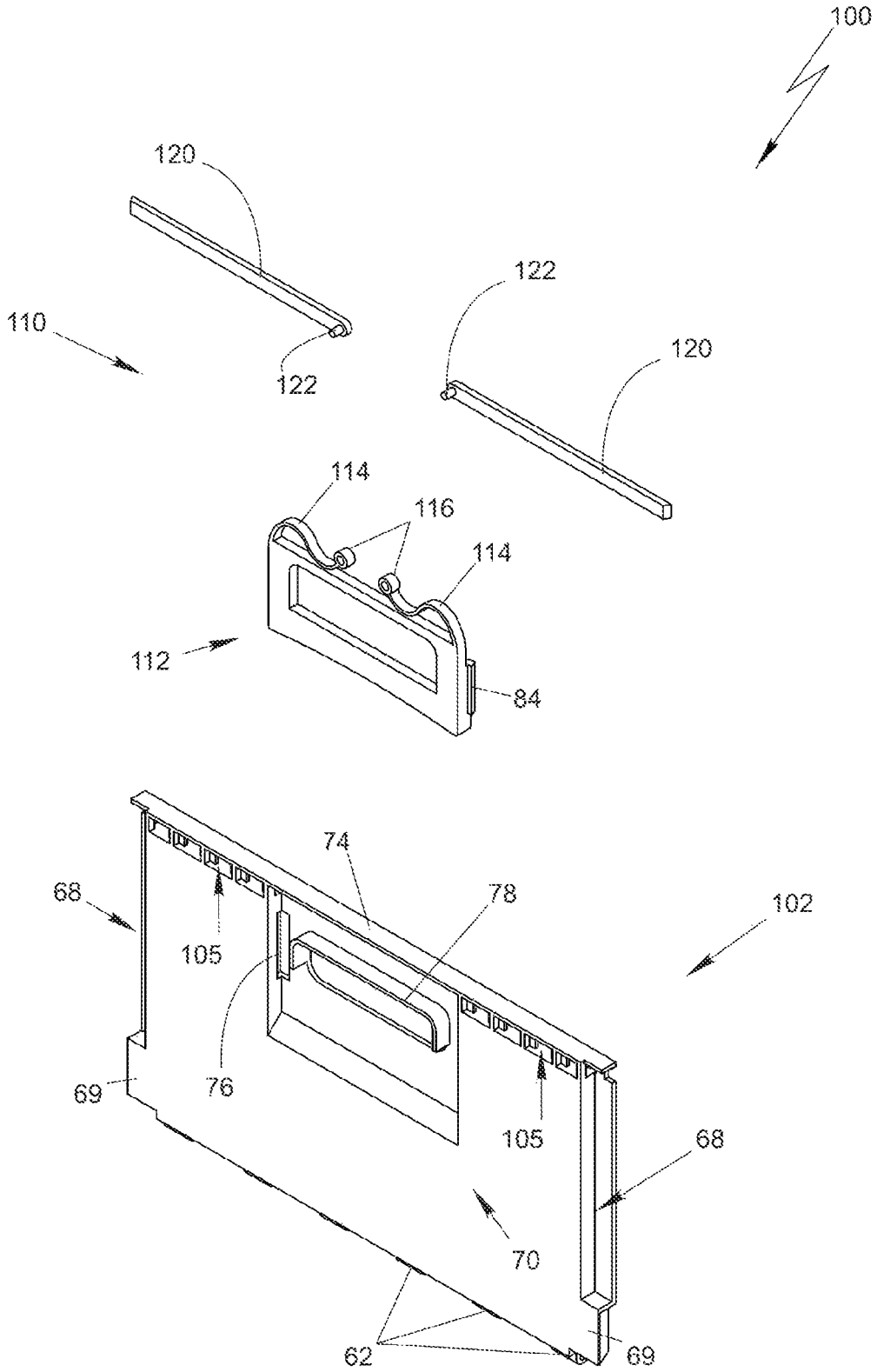
FIG. 5A is an exploded isometric view of alternative flanking sidewall and the locking mechanism thereof, in accordance with another embodiment of the instant invention.

Referring now particularly to FIG. 4A to 4C shows locking mechanism 80 in greater details. Locking mechanism 80 comprises actuator 82. Actuator 82 comprises side ridges 84 positioned along the sides thereof and aperture 86 positioned typically somewhat offset the centerline of top portion 85 of actuator 82. Actuator 82 further comprises or embodies a couple of leaf-springs 88, extending from the top corner upwards and towards the centerline of actuator 82. Actuator 82 defines tab 89, approximately congruent to tab 66 of flanking sidewalls 60.

Actuator 82 is slidable in structured centric recess 70, of flanking sidewalls 60. Side ridges 84 of actuator 82 are inserted into grooves 76 of structured centric recess 70 and slidable therein. Vertical translation of actuator 82 upwards is restricted by top face 74 of structured centric recess 70 and top portion 85 of actuator 82; whereas vertical translation of actuator 82 downwards is restricted by protrusion 78, in structured centric recess 70, essentially surrounding the top portion of tab 66, and top portion 85 of actuator 82. Leaf-springs 88, spontaneously drive actuator 82 in a downward direction, by bouncing against top face 74 of structured centric recess 70.

Locking mechanism 80 further comprises rotor 90. Rotor 90 is adopted to be inserted into and rotated in circular indentation/aperture 79, in structured centric recess 70, of flanking sidewalls 60. Rotor 90 comprises driven pin 92 and a couple of driving pins 94. Driven pin 92 of rotor 90 is inserted into aperture 86 in top portion 85 of actuator 82. Locking mechanism 80 further comprises locking elements 96, threaded into channels 65 at the top portion of flanking sidewalls 60. It is noted that channels 65 are somewhat wider than locking elements 96; thereby sustaining vertical displacement of the latter within the former. Locking elements 96 are furnished with apertures 98, which is threaded onto driving pins 94 of rotor 90.

Upon forceful elevation of actuator 82 in an upward direction, driven pin 92 of rotor 90, threaded into aperture 86 in top portion 85 of actuator 82, exerts rotational torque onto rotor 90. It is noted that deepened bottom portion 72 in structured centric recess 70 is used for manual access to actuator 82 from the underneath. It is further noted that preferably tab 89 in actuator 82, which is approximately congruent to tab 66 in flanking sidewalls 60, only when actuator 82 is in a released position, shown in FIGS. 3A and 3B; whereas when actuator 82 is in an elevated position (not shown), the bottom portion of actuator 82 partially obstructs tab 66 in flanking sidewalls 60; thereby preventing inadvertent usage of crate 30, while actuator 82 is in an elevated position (not shown).

Upon forceful elevation of actuator 82 upwards and consequent rotation of rotor 90, driving pins 94 of rotor 90 are translated towards the vertical centerline of rotor 90 and somewhat away from the horizontal centerline of rotor 90. Consequently, locking elements 96 are retracted into channels 65 at the top portion of flanking sidewalls 60. Except of being retracted into channels 65 of flanking sidewalls 60, upon rotation of rotor 90, locking elements 96 are vertically displaced inside channels 65. However since apertures 98 of locking elements 96 are rotatably threaded onto driving pins 94 of rotor 90, terminal portions 99 locking elements 96 essentially do not move vertically but rater translated laterally.

Upon release of a forceful elevation of actuator 82 in an upward direction, leaf-springs 88, spontaneously drive actuator 82 in a downward direction. Upon spontaneous translation of actuator 82 in a downward direction, locking elements 96 are protracted from channels 65 of flanking sidewalls 60, into longitudinal sidewalls 50; thereby locking longitudinal sidewalls 50 in an upward position, adjacent to flanking sidewalls 60, in the assembled state of crate 30, shown in FIGS. 3A and 3B.

Reference is now made to FIG. 5A to 6B, showing flanking sidewall 100 and the locking mechanism 110, in accordance with another embodiment of the instant invention. Flanking sidewall 100 include a plurality of structural elements 62, disposed about at the bottom portion thereof. Structural elements 62 disposed at the bottom portion of flanking sidewall 60 are adapted to be inserted into structural recesses, disposed about the flanking portion of the base platform (not shown). Structural elements 62 include an aperture (not shown) adapted to receive a pivot; thereby forming a hinged connection between flanking sidewall 100 and the base platform (not shown).

Flanking sidewall 100 include a tab, adapted to serve as a gripping handle. It is noted that flanking sidewalls 100 include side recesses 68, extending essentially inwardly, along a substantial length of the vertical edges of flanking sidewall 100. It is further noted that side recesses 68, of flanking sidewall 100, preferably terminate at some distance from the bottom longitudinal sidewall 100; hence forming rectangular protrusions 69 towards the bottom of flanking recesses 68.

Flanking sidewall 100 comprise a structured centric recess, essentially surrounding the aforementioned tab. The structured centric recess of flanking sidewall 100 is adapted to accommodate locking mechanism 100. The structured centric recess in flanking sidewalls 100 comprises top face 74. The structured centric recess includes a couple of grooves 76 along a portion of the sides thereof and protrusion 78, essentially surrounding the top portion of the aforementioned tab.

It is noted that in the assembled state of the crate employing flanking sidewall 100 (not shown), the flanking extensions of the longitudinal sidewalls overlap side recesses 68 of flanking sidewall 100, thereby interlocking flanking sidewall 100, in an upward position, adjacent to the longitudinal sidewalls. Moreover in the assembled state of the crate employing flanking sidewall 100 (not shown), rectangular protrusions 69 towards the bottom of flanking recesses 68 of flanking sidewall 100 interlock into the rectangular recesses towards the bottom of the flanking extensions of longitudinal sidewalls.

Figure 6A:
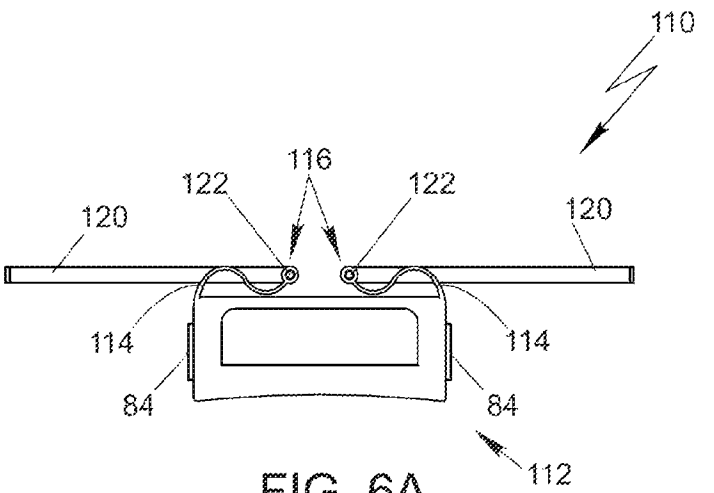
FIG. 6A is a front view of the locking mechanism of the flanking sidewall, shown in FIG. 5A.
Figure 6B:
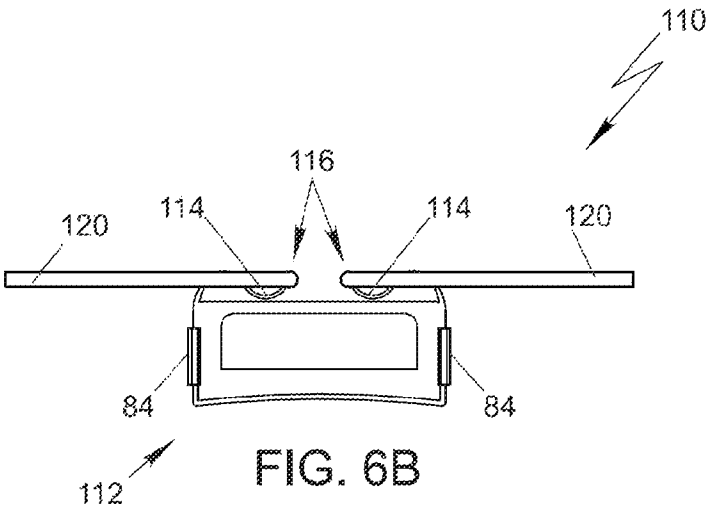
FIG. 6B is a rear view of the locking mechanism of the flanking sidewall, shown in FIG. 5A.
Figure 5B:
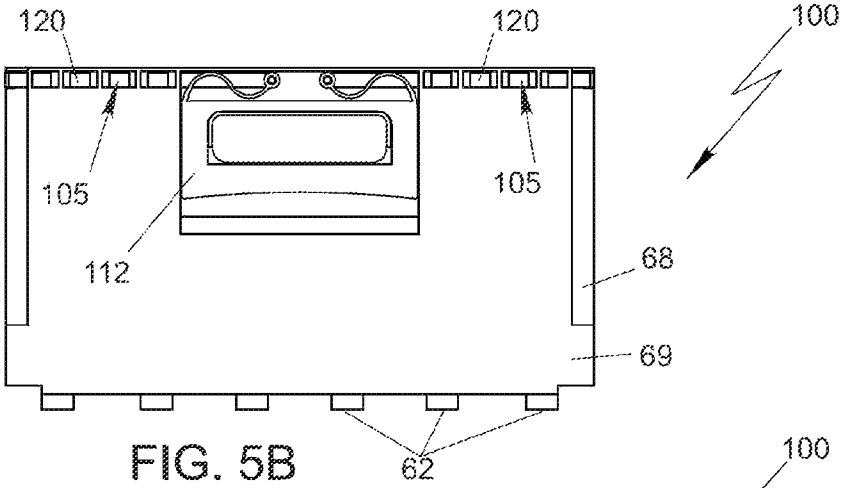
FIG. 5B is a front view of the alternative flanking sidewall and locking mechanism, shown in FIG. 5A.
Figure 5C:
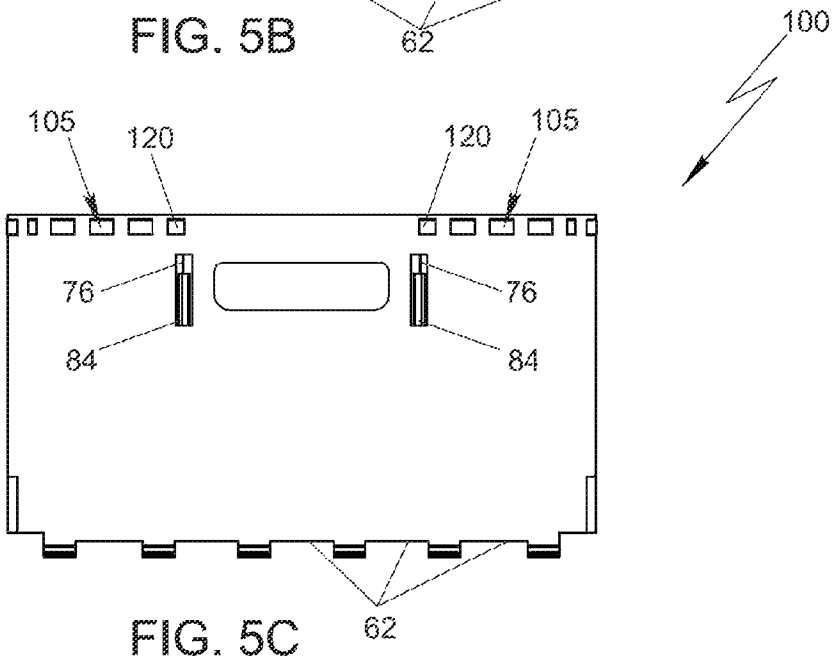
FIG. 5C is a rear view of the flanking sidewall and locking mechanism, shown in FIG. 5A.
Figure 8A:
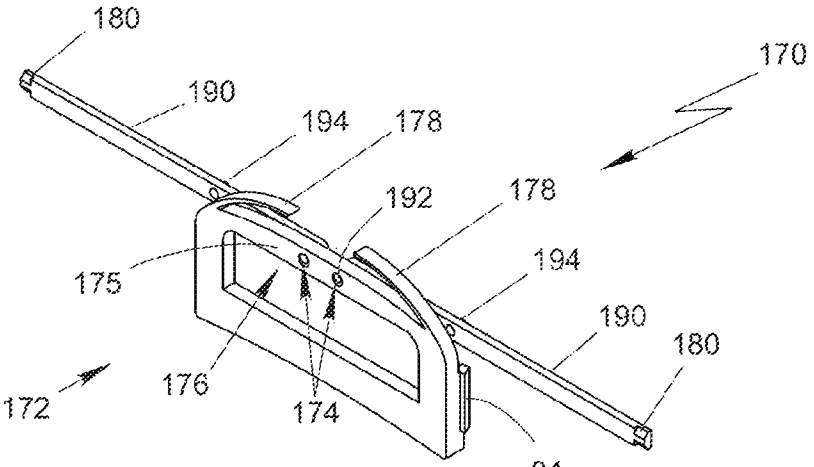
FIG. 8A is a frontal isometric view of the locking mechanism of the flanking sidewall, shown in FIG. 7A.
Figure 8B:
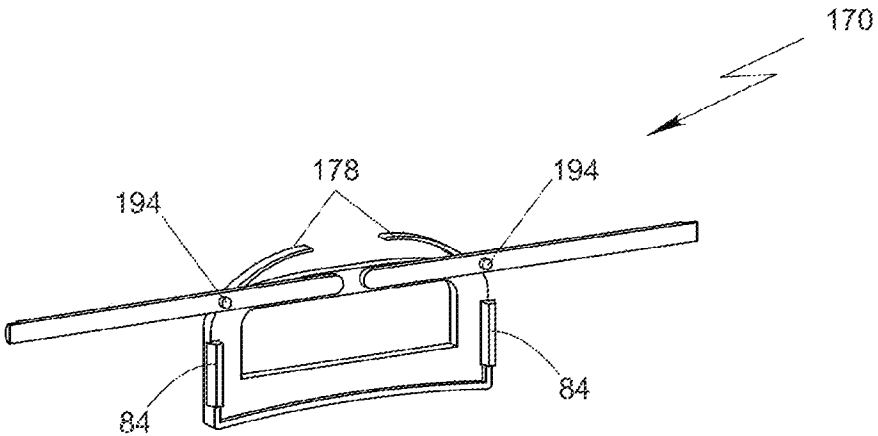
FIG. 8B is a posterior isometric view of the locking mechanism of the flanking sidewall, shown in FIG. 7A.
Figure 7A:
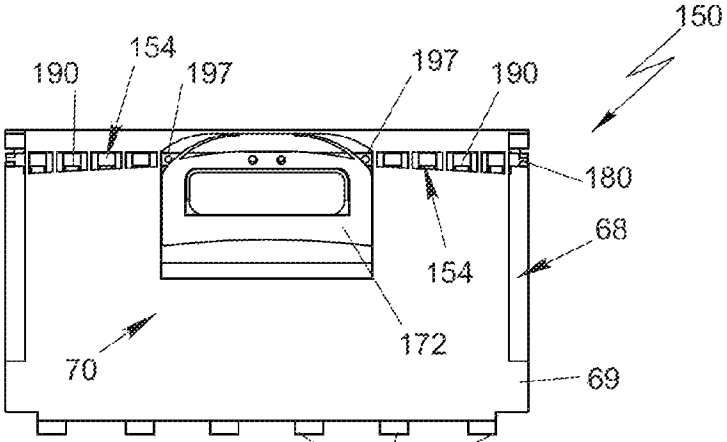
FIG. 7A is a front view of yet another flanking sidewall as well as the locking mechanism thereof, in accordance with yet another embodiment of the instant invention.
Figure 7B:
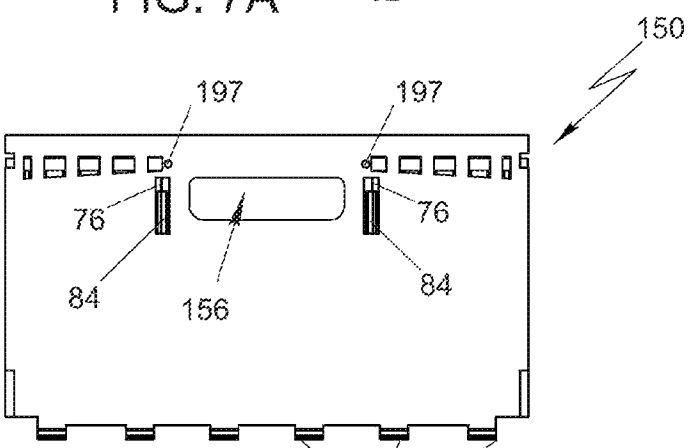
FIG. 7B is a rear view of the flanking sidewall and locking mechanism, shown in FIG. 7A.
Figure 9A:
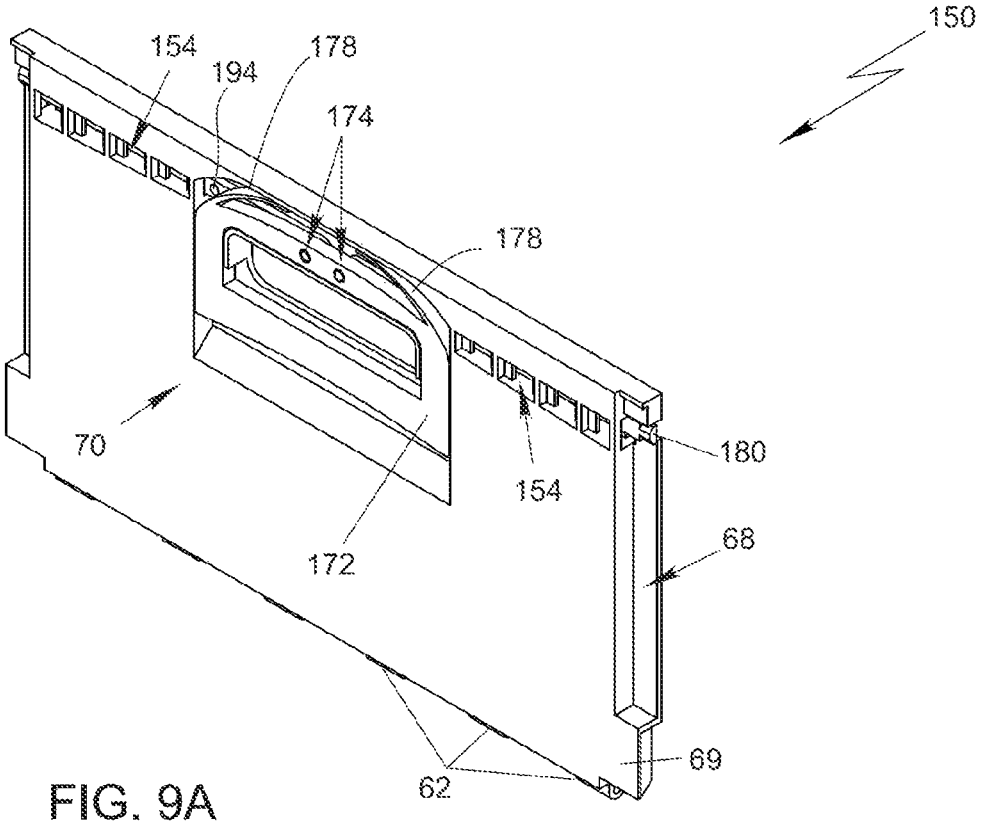
FIG. 9A is an isometric view of the flanking sidewall, shown in FIG. 7A, with the locking mechanism in closed conformation.
Figure 9B:
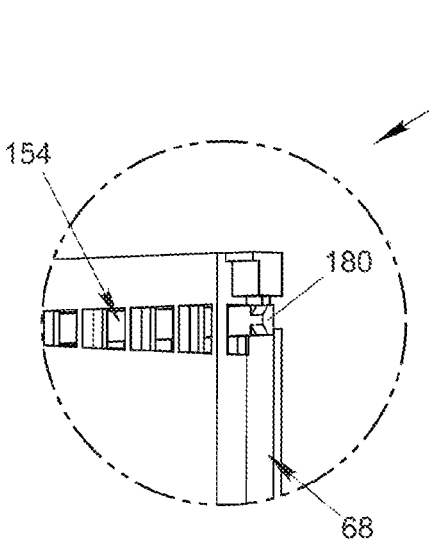
FIG. 9B is an enlarged view of a portion the flanking sidewall, shown in FIG. 7A, showing the locking members in closed conformation.
Figure 9C:
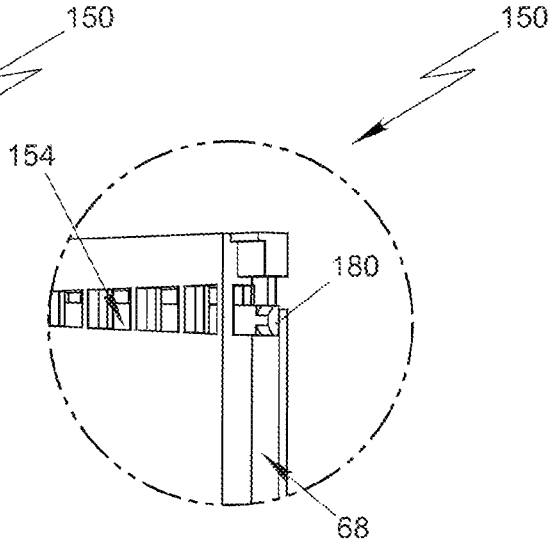
FIG. 9C is an enlarged view of a portion the flanking sidewall, shown in FIG. 9B, showing the locking member in open conformation.

Referring now particularly to FIG. 6A to 6B shows locking mechanism 110 in greater details. Locking mechanism 110 comprises actuator 112. Actuator 112 comprises side ridges 84 positioned along the sides thereof. Actuator 82 further comprises or embodies a couple of sinusoidally shaped driving extensions 114, extending upwards from the top corner of actuator 82. Sinusoidally shaped driving extensions 114 are furnished with connectors 116 at the terminal portions thereof. It is emphasized that sinusoidally shaped driving extensions 114, contradistinctively to the prior art, embody a shape of an essentially complete sinusoidal cycle. It is further noted that preferably sinusoidally shaped driving extensions 114 extend from actuator 82 at an orientation essentially exceeding a 45 degrees angle; whereas connectors 116 furnishing the terminal portion of extensions 114 are connected to locking elements 120 at an orientation essentially preceding a 45 degrees angle e. Sinusoidally shaped driving extensions 114, embodying a shape of an essentially complete sinusoidal cycle, are positioned horizontally, namely in the direction of translation of locking elements 120, which are threaded into channels 105, at the top portion of flanking sidewall 100. Locking elements 120 are connected to sinusoidally shaped driving extensions 114 by the means of pins 122, which are inserted into connectors 116 furnishing the terminal portion of extensions 114.

Actuator 112 is slidable in the structured centric recess, of flanking sidewall 100. Side ridges 84 of actuator 112 are inserted into grooves 76 of the structured centric recess and slidable therein. Vertical translation of actuator 112 upwards is restricted by top face 74 of the structured centric recess and the top portion of actuator 112; whereas vertical translation of actuator 112 downwards is restricted by protrusion 78, of the structured centric recess, essentially surrounding the top portion of the aforementioned tab. Sinusoidally shaped driving extensions 114, spontaneously drive actuator 112 in a downward direction, by bouncing against top face 74 of the structured centric recess.

Locking mechanism 110 further comprises locking elements 120, threaded into channels 105 at the top portion of flanking sidewall 100. It is noted that channels 105 are essentially of the same width as locking elements 105; thereby sustaining merely lateral displacement of the latter within the former. Locking elements 120 are furnished with pins 122, which are inserted into connectors 116 of sinusoidally shaped driving extensions 114.

Upon forceful elevation of actuator 112 in an upward direction, connectors 116 of sinusoidally shaped driving extensions 114 exert lateral force onto pins 122 of locking elements 120. It is further noted that the tab in actuator 112, which is approximately congruent to the tab in flanking sidewall 100, only when actuator 112 is in a released position, shown in FIGS. 5B and 5C; whereas when actuator 112 is in an elevated position (not shown), the bottom portion of actuator 112 partially obstructs the tab in flanking sidewall 100; thereby preventing inadvertent usage of the crate, while actuator 112 is in an elevated position (not shown).

Upon forceful elevation of actuator 112 upwards, connectors 116 of sinusoidally shaped driving extensions 114 are translated towards the vertical centerline of actuator 112 essentially in parallel to horizontal centerline of actuator 112. Consequently, locking elements 120 are retracted into channels 105 at the top portion of flanking sidewall 100. While being retracted into channels 105 of flanking sidewall 100, locking elements 120 are not vertically displaced inside channels 105.

Upon release of a forceful elevation of actuator 112 in an upward direction, sinusoidally shaped driving extensions 114, spontaneously drive actuator 112 in a downward direction. Upon spontaneous translation of actuator 112 in a downward direction, locking elements 120 are protracted from channels 105 of flanking sidewall 120, into the longitudinal sidewalls; thereby locking the longitudinal sidewalls in an upward position, adjacent to flanking sidewall 100, in the assembled state of the folding crate (not shown).

Reference is now made to FIG. 7A to 9C, showing flanking sidewall 150 and the locking mechanism 170, in accordance with another embodiment of the instant invention. Flanking sidewall 150 include a plurality of structural elements 62, disposed at the bottom portion thereof. Structural elements 62 disposed at the bottom portion of flanking sidewall 150 are adapted to be inserted into the structural recesses, disposed about the flanking portion of the base platform. Structural elements 62 include an aperture (not shown) adapted to receive a flanking pivot; thereby forming a hinged connection between flanking sidewall 150 and the flanking portion of the base platform.

Flanking sidewalls 150 include tab 156, adapted to serve as a gripping handle. It is noted that flanking sidewall 150 include side recesses 68, extending essentially inwardly, along a substantial length of the vertical edges of flanking sidewall 150. It is further noted that side recesses 68, of flanking sidewall 150, preferably terminate at some distance from the bottom longitudinal sidewall 150; hence forming rectangular protrusions 69 towards the bottom of flanking recesses 68.

Flanking sidewall 150 comprises structured centric recess 70, essentially surrounding tab 156. Structured centric recess 70, of flanking sidewall 150, is adapted to accommodate locking mechanism 170. Structured centric recess 70 in flanking sidewall 150 comprises a top face. Structured centric recess 70 includes a couple of grooves 76 along a portion of the sides thereof and a protrusion, essentially surrounding the top portion of tab 156.

It is noted that in the assembled state of the foldable crate, shown in FIGS. 3A and 3B, flanking extensions of longitudinal sidewalls overlap side recesses 68 of flanking sidewall 150, thereby interlocking flanking sidewall 150, in an upward position, adjacent to the longitudinal sidewalls. Moreover in the assembled state of the foldable crate, rectangular protrusions 69 towards the bottom of flanking recesses 68 of flanking sidewall 150 interlock into rectangular recesses at the bottom of the flanking extensions of longitudinal sidewalls.

Referring now particularly to FIG. 8A to 8F shows locking mechanism 170, which employs swinging locking elements, in greater details. Locking mechanism 170 comprises actuator 172. Actuator 172 comprises side ridges 84 positioned along the sides thereof and a couple of apertures 174 positioned typically somewhat offset the centerline of top portion 175 of actuator 172. Actuator 172 further comprises or embodies a couple of leaf-springs 178, extending from the top corner upwards of top portion 175 of actuator 172 and towards the centerline of actuator 172. Actuator 172 defines a tab, approximately congruent to tab 156 of flanking sidewall 150.

Actuator 172 is slidable in structured centric recess 70, of flanking sidewall 150. Side ridges 84 of actuator 172 are inserted into grooves 76 of structured centric recess 70 and slidable therein. Vertical translation of actuator 172 upwards is restricted by the top face of structured centric recess 70 and top portion 175 of actuator 172; whereas vertical translation of actuator 172 downwards is restricted by the protrusion of structured centric recess 70, essentially surrounding the top portion of tab 156, and top portion 175 of actuator 172. Leaf-springs 178 spontaneously drive actuator 172 in a downward direction, by bouncing against the top face of structured centric recess 70.

Locking mechanism 170 further comprises a pair of hinge apertures 197, at the top corners of structured centric recess 70, in flanking sidewall 150. The pair of hinge apertures 197 is adapted to accommodate hinge pins 194 of locking elements 190. Locking mechanism 170 further comprises locking elements 190, inserted into channels 154 at the top portion of flanking sidewall 150. It is noted that channels 154 are essentially wider than locking elements 190; thereby sustaining swinging movement of the latter within the former. Locking elements 190 are furnished with pins 192, which is inserted into the couple of apertures 174 at top portion 175 of actuator 172. Terminal portions 180 of locking elements 190 preferably comprise chamfered faces, adapted to be inserted more fluently into respective locking recesses of the longitudinal sidewalls, by a swinging movement, as elaborated infra.

Upon forceful elevation of actuator 172 in an upward direction, the couple of apertures 174 at top portion 175 of actuator 172, exert rotational torque onto locking elements 190. It is noted that that the tab in actuator 172 is approximately congruent to tab 156 in flanking sidewall 150, only when actuator 172 is in a released position, shown in FIGS. 8B and 8C; whereas when actuator 172 is in an elevated position, shown in FIG. 8D, the bottom portion of actuator 172 partially obstructs tab 156 in flanking sidewall 150; thereby preventing inadvertent usage of the foldable crate, while actuator 172 is in an elevated position, shown in FIG. 8D.

Upon forceful elevation of actuator 172 upwards, a consequent rotation locking elements 190, about pins 194, which are inserted into hinge apertures 197, at the top corners of structured centric recess 70, of flanking sidewall 150, occurs. Consequently, locking elements 190 perform a swinging movement inside channels 154 at the top portion of flanking sidewall 150. Upon rotation of locking elements 190, about pins 194, terminal portions of locking elements 190 are vertically displaced inside channels 154. Since pins 194 of locking elements 190 are rotatably threaded into hinge apertures 197, at the top corners of structured centric recess 70, terminal portions 180 of locking elements 190 move essentially vertically and downwards, shown in FIG. 9C.

Upon release of a forceful elevation of actuator 172 in an upward direction, leaf-springs 178, spontaneously drive actuator 172 in a downward direction. Upon spontaneous translation of actuator 172 in a downward direction, locking elements 190 are rotated inside channels 154 of flanking sidewall 150, so that terminal portions thereof move essentially vertically and upwards, shown in FIGS. 9A and 9B, and consequently are inserted into longitudinal sidewalls; thereby locking the longitudinal sidewalls in an upward position, adjacent to flanking sidewall 150, in the assembled state of the foldable crate, as shown in FIGS. 3A and 3B.

BIBLIOGRAPHICAL CITATION LIST OF PATENT LITERATURE

U.S. patents and patent applications Pub. No. U.S. Pat. Nos. 7,861,878, 6,290,081, US20100230406, US20120091133 and US20100320202;

EP patent publications No. EP2431283 and EP1655232;

International patent applications Pub. No. WO2010146190 and WO2009100799.

It will be appreciated by persons skilled in the art that the present invention is not limited by what has been particularly shown and described herein above. Rather the scope of the invention is defined by the claims which follow:

What is claimed is:

1. A foldable crate comprises:

(a) a base platform, said base platform comprising:
  (I) a pair of longitudinal portions;
  (II) a pair of flanking portions;
  (III) at least one structural element, disposed adjacently to said longitudinal portions of said base platform;
  (IV) at least one structural element, disposed adjacently to said flanking portions of said base platform;

(b) a pair of longitudinal sidewalls, each one of said longitudinal sidewalls comprises at least one structural element, configured to form a hinged connection with said at least one structural element, disposed adjacently to said longitudinal portion of said base platform;

(c) a pair of flanking sidewalls, each one of said flanking sidewalls comprises:

(I) at least one structural element, configured to form a hinged connection with said at least one structural element, disposed adjacently to said flanking portion of said base platform;

(II) a tab, configured to serve as a gripping handle;

(III) a structured centric recess, essentially surrounding said tab, configured to accommodate a locking mechanism;

(IV) a pair of channels at a top portion of said flanking sidewall;

(d) a pair of locking mechanisms disposed inside flanking sidewalls, each of said locking mechanisms comprises:

(I) an actuator, each one of said actuators is slidable inside said structured centric recess of flanking said sidewalls and comprises:

(i) a pair of sinusoidally shaped driving extensions, wherein said sinusoidally shaped driving extensions embody a shape of an essentially complete sinusoidal cycle, and wherein said sinusoidally shaped driving extensions extend from said actuator at an orientation essentially exceeding a 45 degree angle;

(ii) a pair of connectors furnishing terminal portions of said sinusoidally shaped driving extensions; wherein said connectors are connectable to said sinusoidally shaped driving extensions at an orientation essentially preceding a 45 degree angle;

(iii) a tab essentially congruent to said tab of said flanking sidewall;

(II) a pair of locking elements, threaded into said channels at said top portion of said flanking sidewalls; wherein said locking elements are operationally connectable to said connectors, furnishing said terminal portions of said sinusoidally shaped driving extensions;

wherein said sinusoidally shaped driving extensions, which embody a shape of an essentially complete sinusoidal cycle, are positioned horizontally, in the direction of translation of said locking elements, wherein upon forceful elevation of said actuator in an upward direction, said sinusoidally shaped driving extensions are compressed and extended in lengths, whereby said locking elements are retracted into said channels, allowing folding said crate;

wherein upon release of said forceful elevation, said sinusoidally shaped driving extensions are released and contracted in lengths and said locking elements are consequently protracted from said channels in said flanking sidewalls, into said longitudinal sidewalls; thereby locking said crate assembled.

2. The crate as in claim 1, wherein said actuator comprises side ridges positioned along the sides thereof and wherein said side ridges of said actuator are inserted into grooves in said structured centric recess and slidable therein.

3. The crate as in claim 1, wherein said longitudinal sidewalls further comprise flanking extensions, extending essentially perpendicularly and outwardly, along a substantial length of vertical edges of said longitudinal sidewalls, and wherein said flanking sidewalls further comprising side recesses, extending essentially inwardly, along a substantial length of vertical edges of said flanking sidewalls.

4. The crate as in claim 3, wherein said flanking extensions, of said longitudinal sidewalls, terminate at some distance from a bottom portion of said longitudinal sidewalls; thereby forming rectangular recesses towards said bottom portion of said flanking extensions, wherein said side recesses, of said flanking sidewalls, terminate at some distance from a bottom portion of said flanking sidewalls; thereby forming rectangular protrusions towards said bottom portion of said side recesses.

5. The crate as in claim 1, wherein said tab in said actuator is congruent to said tab in said flanking sidewall, only when said actuator is in released position.

6. The crate as in claim 1, wherein said channels comprise substantially a width as said locking elements; thereby sustaining merely lateral displacement of said locking elements within the former.

7. The crate as in claim 1 wherein said locking elements are furnished with pins, which are inserted into said connectors, furnishing said terminal portions of said sinusoidally shaped driving extensions.

* * * * *